United States Patent [19]

Kato

[11] Patent Number: 5,012,855

[45] Date of Patent: May 7, 1991

[54] INDUSTRIAL ROBOT

[75] Inventor: Hisao Kato, Aichi, Japan

[73] Assignee: Mitsubishi Denki Kabushiki Kaisha, Tokyo, Japan

[21] Appl. No.: 251,289

[22] Filed: Sep. 30, 1988

[30] Foreign Application Priority Data

Sep. 30, 1987 [JP] Japan ..... 62-247215

[51] Int. Cl.[5] ..... B22D 37/00

[52] U.S. Cl. ..... 164/155; 164/335

[58] Field of Search ..... 164/155, 156, 335

[56] References Cited

U.S. PATENT DOCUMENTS

| | | | |
|---|---|---|---|
| 3,943,992 | 3/1976 | Metzger | 164/156 |
| 4,134,444 | 1/1979 | Fujie et al. | 164/155 |
| 4,210,192 | 7/1980 | Lavanchy et al. | 164/155 |
| 4,227,565 | 10/1980 | Lavanchy et al. | 164/457 |
| 4,396,945 | 8/1983 | Di Matteo et al. | 358/107 |
| 4,427,880 | 1/1984 | Kanade et al. | 356/4 |
| 4,724,894 | 2/1988 | Sjodahl | 164/155 |

FOREIGN PATENT DOCUMENTS

| | | | |
|---|---|---|---|
| 2639793 | 9/1977 | Fed. Rep. of Germany | 164/155 |
| 2815957 | 10/1979 | Fed. Rep. of Germany | 164/155 |
| 20969 | 6/1976 | Japan | 164/322 |
| 103774 | 6/1982 | Japan | 164/155 |
| 85355 | 5/1984 | Japan | 164/155 |
| 166360 | 9/1984 | Japan | 164/156 |
| 232056 | 10/1986 | Japan | 164/155 |
| 245964 | 11/1986 | Japan | 164/155 |
| 16869 | 1/1987 | Japan | 164/155 |
| 118965 | 5/1987 | Japan | 164/155 |
| 299850 | 12/1988 | Japan | 164/155 |
| 617166 | 7/1978 | U.S.S.R. | 164/155 |

*Primary Examiner*—Richard K. Seidel
*Assistant Examiner*—Edward A. Brown
*Attorney, Agent, or Firm*—Sughrue, Mion, Zinn, Macpeak & Seas

[57] ABSTRACT

An industrial robot for casting products by pouring molten metal in a ladle mounted on an arm thereof to successively conveyed molds, comprises a drive mechanism for driving the ladle to incline with respect to the mold, means for measuring a level of molten metal in the mold, means for detecting an inclination rate of the ladle and a central processing unit having a memory for storing an optimum level of molten metal in the mold and inclination rate of the ladle, the central processing unit being adapted to receive a level data from the measuring means and an inclination rate data from the detecting means, compare the data with the optimum level and inclination rate, calculate deviations of the data from the optimum level and inclination, and supply control signals to the drive mechaniam to control the latter optimally.

5 Claims, 2 Drawing Sheets

INDUSTRIAL ROBOT

BACKGROUND OF THE INVENTION

The present invention relates to an industrial robot, and, particularly, to an industrial robot for use in a casting field to pour molten metal into a mold.

In the casting industry, a pouring of molten metal into a mold has been performed mainly by skilled personnel since it is very important to select a pouring rate suitably, otherwise, molded products may be deformed, or the mold may be broken. However, environmental working conditions of the casting factory are severe due to high temperature and dusty air which are not suitable for human workers. In order to solve this problem, a substitution of a robot for skilled personnel has been considered and an example of this consideration is disclosed in Japanese Patent Application Laid-open No. 229463/1986. An industrial robot disclosed in the latter is characterized by reducing an effect of high temperature environment on a driving mechanism of the robot.

In such a conventional industrial robot, a transfer of techniques of skilled personnel based on experiences and feelings to the robot has not been realized to the extent that the robot can perform the techniques reliably.

SUMMARY OF THE INVENTION

An object of the present invention is into provide an industrial robot by which a pouring of molten metal to a mold is performed under conditions which are optimum for the mold so as to prevent a breakage of the mold and deformation of molded products.

The above object of the present invention is achieved by a provision of an industrial robot having a ladle mounted on an arm of the robot in which the ladle is inclined in a vertical plane by a driving mechanism of the robot to pour molten metal therein into a mold while measuring a level of molten metal in the mold by means of a measuring device. The level data of molten metal in the mold and an inclination rate of the ladle are sent to a CPU in which these data are compared with respective optimum values preliminarily stored in a memory of the CPU to obtain deviations of the respective data upon which control signals are sent to the driving mechanism to control pouring rate an optimum.

According to the present device, the pouring rate of molten metal from the ladle into the mold is controlled to be optimum, so that the problems of breakage of the mold and deformations of products are prevented.

DETAILED DESCRIPTION OF THE PREFERRED EMBODIMENT

Figure 1:
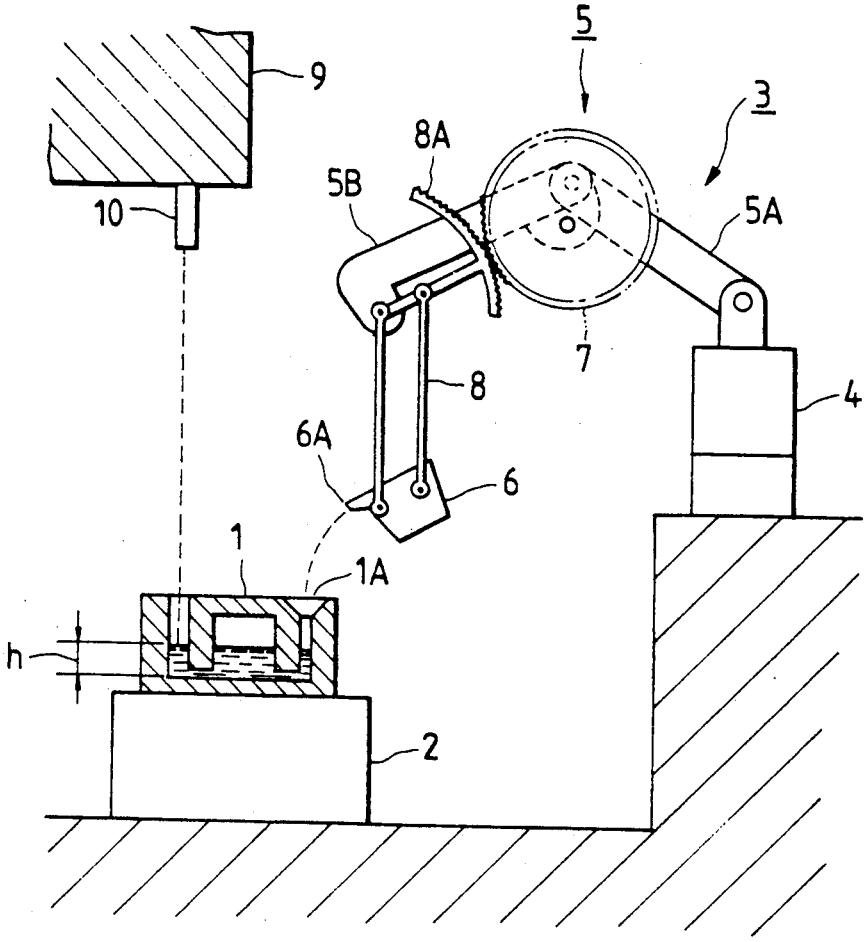
FIG. 1 illustrates an embodiment of an industrial robot according to the present invention.

In FIG. 1, which illustrates an embodiment of the present invention, a robot is arranged on one side of a conveyer 2 for transporting a mold 1 in a direction perpendicular to the drawing sheet so that molten metal is poured thereby into the mold 1. The robot includes a main body 4 and an arm 5 extending therefrom above the conveyer 2. The arm 5 is composed of a first arm portion 5A having one end rotatably connected to an upper portion of the main body 4 and a second arm portion 5B having one end articulated with the other end of the first arm portion 5A. A gear 7 is provided around the articulation for driving a ladle 6 supported by a link mechanism 8 composed of the other end of the second arm portion 5B and an arched rack 8A meshed with the gear 7 to incline the ladle 6 above the mold 1 thereby to pour molten metal in the ladle 6 into the mold 1. The robot is preliminarily taught that a pouring end 6A of the ladle 6 comes to a position just above an opening 1A of the mold 1.

A ceiling 9 over the conveyer 2 suspends a distance meter 10 for measuring a level h of molten metal in the mold 1 so that the level of the molten metal being poured is measured continuously by the meter 10 to determine an increaseing rate of the level h. The increasing rate of the level h is related to the pouring rate of the molten metal, and, hence, the inclination rate of the ladle 6.

An optimum value of the inclination rate of the ladle 6 depends upon the mold 1 to be used and the physical properties of a mold product to be produced, which has been determined empirically by those skilled personnel. The optimum value concerning the inclination rate of the ladle 6 is preliminarily stored in a memory of a CPU 11 housed in the main body 4, and is compared with an actual rate. The ladle 6 is controlled on the basis of the deviation of the actual value from the stored value.

Figure 2:
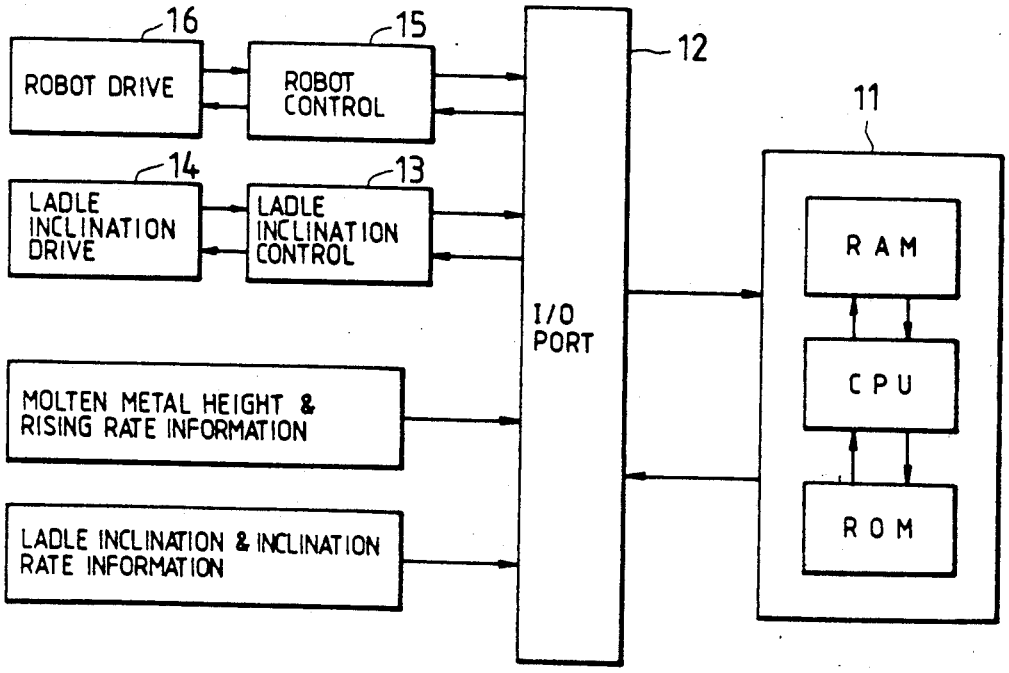
FIG. 2 is a block diagram of a main portion of the robot shown in FIG. 1.

FIG. 2 shows a control portion of the present robot. In FIG. 2, the rising rate of the level of the molten metal in the mold 1 and the inclination rate of the ladle 6 are inputted through an I/O port 12 to the CPU 11 as measured values. In the CPU 11, these measured values are compared with the optimum values stored in the memory and a control signal based on a resultant deviation is supplied through the I/O port 12 to a control device 13 of the ladle 6, upon which a drive device 14, i.e., the link mechanism 8 including the gear 7 and the rack 8A, is actuated to correct the inclination rate of the ladle 6 to the optimum rate thereby to obtain an optimum amount of poured molten metal.

In this case, the position of the robot arm 5 is controlled by the control device 15 on the basis of the control signal supplied thereto from the CPU 11 through the I/O port 12 so that the drive device 16 is operated such that the optimum position of the ladle 6 is obtained.

Figure 3:
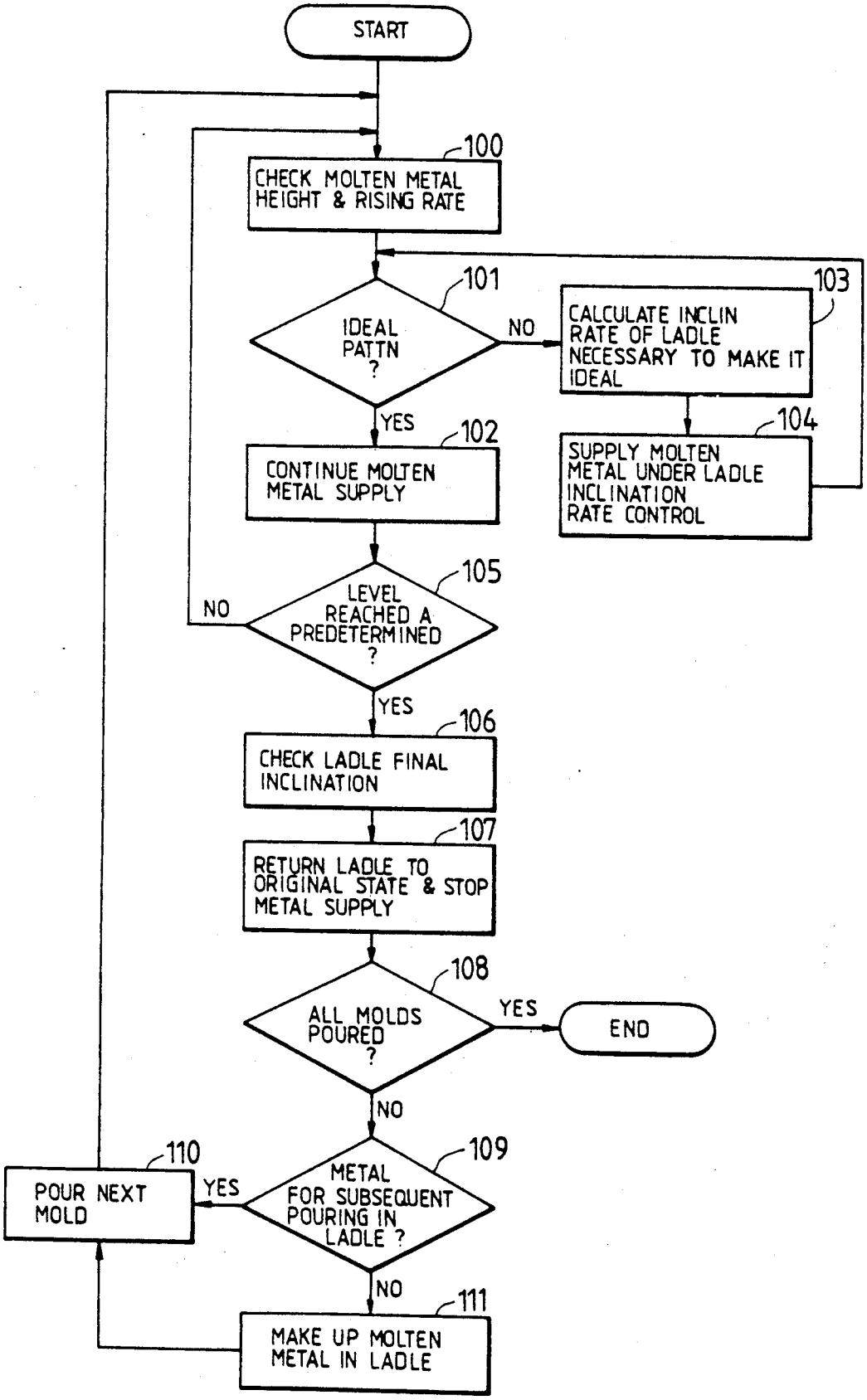
FIG. 3 is a flowchart for explanation of the operation thereof.

The above operation of this invention is shown by a flowchart in FIG. 3. In FIG. 3, first, a pouring of molten metal from the ladle 6 into the mold 1 commences and a level and a rising rate of the molten metal level in the mold 1 are detected by the meter 10 and inputted to the CPU 11 in which they are checked with respect to the stored optimum values in the step 100. In the step 101, these measured values are examined to determined whether or not they are coincident with an ideal pattern indicative of the optimum values. If the actual values are coincident with the ideal pattern, the pouring operation is continued in the step 102. If they are not coincident with the ideal pattern, a deviation of the actual inclination rate of the ladle 6 from the optimum value is calculated in the step 103 upon which the drive device 14 of the ladle 6, i.e., the gear 7 is rotated in either direction to regulate it so that the actual inclination rate becomes the optimum value in the step 104. Then, the operation is returned to the step 101. It should be noted that the measurement of the actual inclination of the ladle 6 can be performed easily by providing a motor having an encoder for measuring a rotation number and a position thereof at the center of the gear 7 and detecting a rotation angle of the gear 7 having a specific geometric relation to the rack 8A and the link mechanism 8. Further, it should be noted that the CPU has data concerning the relation between the position of the gear 7 and the inclination of the ladle 6, and data concerning relation between the flow-rate of the molten metal with respect to a minute variation of the inclination angle of the ladle 6 at respective angles. The inclination rate of the ladle 6 can be calculated on the basis of the positional variation of the gear 7.

The level of molten metal in the mold 1 which is continuously measured by the measuring device 10 is examined to determine whether or not the level reaches a level in the step 105. When the level reaches the predetermined level, the inclination of the ladle 6 is checked in the step 106 and the ladle 6 is rotated into the reverse direction to stop the pouring of molten metal to the mold 1 in the step 107. Then, in the step 108, it is determined whether or not the pouring of molten metal to all of the conveyed molds 1 is completed and, if so, the operation is finished.

When the determination in the step 105 is negative, the operation is returned to the step 100.

When the pouring operation into the molds 1 is not completed, it is determined in the step 109 whether or not there is enough molten metal in the ladle 6 for molding subsequent work. If so, a pouring into a next mold 1 is started in the step 110, and the same operation described above is repeated. If the ladle 6 does not have enough molten metal, the ladle 6 is made up with molten metal in the step 111, and the operation is shifted to the step 110.

The measuring device 10 for measuring the level or depth h of molten metal in the mold 1 may be a conventional distance meter such as an ultrasonic type or a laser type.

As described hereinbefore, according to the present invention, it is possible to remove the necessity of experienced personnel in the casting factory.

What is claimed is:

1. An industrial robot for casting products by pouring molten metal in a ladle mounted on an arm of said robot into successively conveyed molds, comprising;

a drive mechanism for driving said ladle to incline with respect to said mold;

measuring means for continuously measuring a level of molten metal in said mold, said measuring means comprising energy radiating means for radiating energy directly into a main portion of said mold to measure said level of molten metal in said mold;

detecting means for detecting an inclination rate of said ladle; and a central processing unit having a memory for storing an optimum level of molten metal in said mold and an inclination rate of said ladle, said central processing unit being connected to said measuring means and said detecting means, and adapted to receive actual level data from said measuring means and actual inclination rate data from said detecting means, compare said actual level data and said actual inclination rate data with said optimum level and inclination rate data stored in said memory, calculate deviations of said actual level data and said actual inclianation rate data from said optimum level and inclination rate, and supply control signals to said drive mechanism to control the latter optimally.

2. The industrial robot as claimed in claim 2, wherein said drive mechanism comprises a link mechanism including a gear and a rack meshed with said gear.

3. The industrial robot as claimed in claim 1 or 2, wherein said measuring means comprises an ultrasonic sensor.

4. The industrial robot as claimed in claim 1, wherein said measuring means comprises a laser.

5. The industrial robot as claimed in claim 2, wherein said measuring means comprises a laser.

* * * * *